US005664620A

United States Patent [19]

Ritter

[11] Patent Number: 5,664,620

[45] Date of Patent: Sep. 9, 1997

[54] ROTARY REGENERATIVE HEAT EXCHANGER

[75] Inventor: Kent E. Ritter, Wellsville, N.Y.

[73] Assignee: ABB Air Preheater Inc., Wellsville, N.Y.

[21] Appl. No.: 683,456

[22] Filed: Jul. 18, 1996

[51] Int. Cl.[6] ..... F23L 15/02

[52] U.S. Cl. ..... 165/8; 165/6; 165/4

[58] Field of Search ..... 165/4, 6, 8, 9

[56] References Cited

U.S. PATENT DOCUMENTS

| | | | |
|---|---|---|---|
| 3,267,562 | 8/1966 | Chiang et al. | 165/6 |
| 4,418,742 | 12/1983 | Conde et al. | 165/8 |
| 4,557,318 | 12/1985 | Bellows | 165/8 X |
| 4,789,024 | 12/1988 | Muscato | 165/8 X |
| 4,838,342 | 6/1989 | Goetschius | 165/8 X |
| 4,984,621 | 1/1991 | Miller et al. | 165/8 X |

FOREIGN PATENT DOCUMENTS

| | | | |
|---|---|---|---|
| 1017774 | 1/1966 | United Kingdom | 165/8 |
| 1401622 | 7/1975 | United Kingdom | 165/8 |

*Primary Examiner*—John Rivell
*Assistant Examiner*—Christopher Atkinson
*Attorney, Agent, or Firm*—Chilton, Alix & Van Kirk

[57] ABSTRACT

The rotor of a rotary regenerative air preheater is constructed for the loading of the heat exchange basket modules into the sectors of the rotor in a radial direction through the periphery of the rotor. The heat exchange basket modules are arranged in a plurality of axially spaced layers with the lower baskets supporting the baskets located above. To provide the support and to facilitate the loading of the baskets, each basket includes an integral grating structure at the top surface thereof which extends partially above the uppermost surface of the basket frame. This provides a clear sliding surface as well as a support for the baskets in the layer above. The invention eliminates the support gratings which are a part of the rotor structure, except at the bottom of the rotor.

5 Claims, 3 Drawing Sheets

ROTARY REGENERATIVE HEAT EXCHANGER

BACKGROUND OF THE INVENTION

The present invention relates to rotary heat regenerative heat exchangers and, more specifically, to improved means for constructing and supporting modular heat exchange baskets in the rotor.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a vertical central rotor post and divided into a plurality of sector-shaped compartments by a plurality of radial partitions or diaphragms extending from the rotor post to the outer peripheral shell of the rotor. These sector-shaped compartments are loaded with modular heat exchange baskets which contain the mass of heat absorbent material commonly comprised of stacked plate-like elements.

The rotor is surrounded by a housing and the ends of the rotor are partially covered by sector plates located between the gas and air inlet and outlet ducts which divide the housing into flue gas and air sides. In order to improve the efficiency of operation, it is conventional to provide seals, which are referred to as radial seals, on the ends of the rotor such that the seals will come into proximity with the sector plates and minimize the flow of gases between the hot and cold sides at the ends of the rotor. These seals are normally attached to the edges of the diaphragms.

The conventional modular heat exchange baskets are loaded axially into the rotor from the top end (duct end) between the diaphragms and stay plates are located between radially adjacent baskets for support. There are normally multiple layers of baskets stacked on top of each other.

In another design, the rotor is constructed for the loading and removal of the baskets in a radial direction through the side of the rotor rather than axially through the duct end. The multiple layers of baskets are positioned and supported in each sector between the diaphragms by gratings fixed between diaphragms at each end of the rotor and between each of the layers of baskets.

SUMMARY OF THE INVENTION

The present invention relates to a novel construction of heat exchange baskets for rotary regenerative heat exchangers and the manner in which those baskets are loaded and supported in the rotor. The rotor is of the type constructed for the loading and removal of the baskets in a radial direction through the periphery of the rotor. The baskets are constructed with an integral grating on the top surfaces which functions as a structural reinforcement of the basket, as a sliding surface for insertion and removal of the baskets in the layer above and as a support for that upper adjacent layer.

DESCRIPTION OF THE PREFERRED EMBODIMENT

Figure 1:
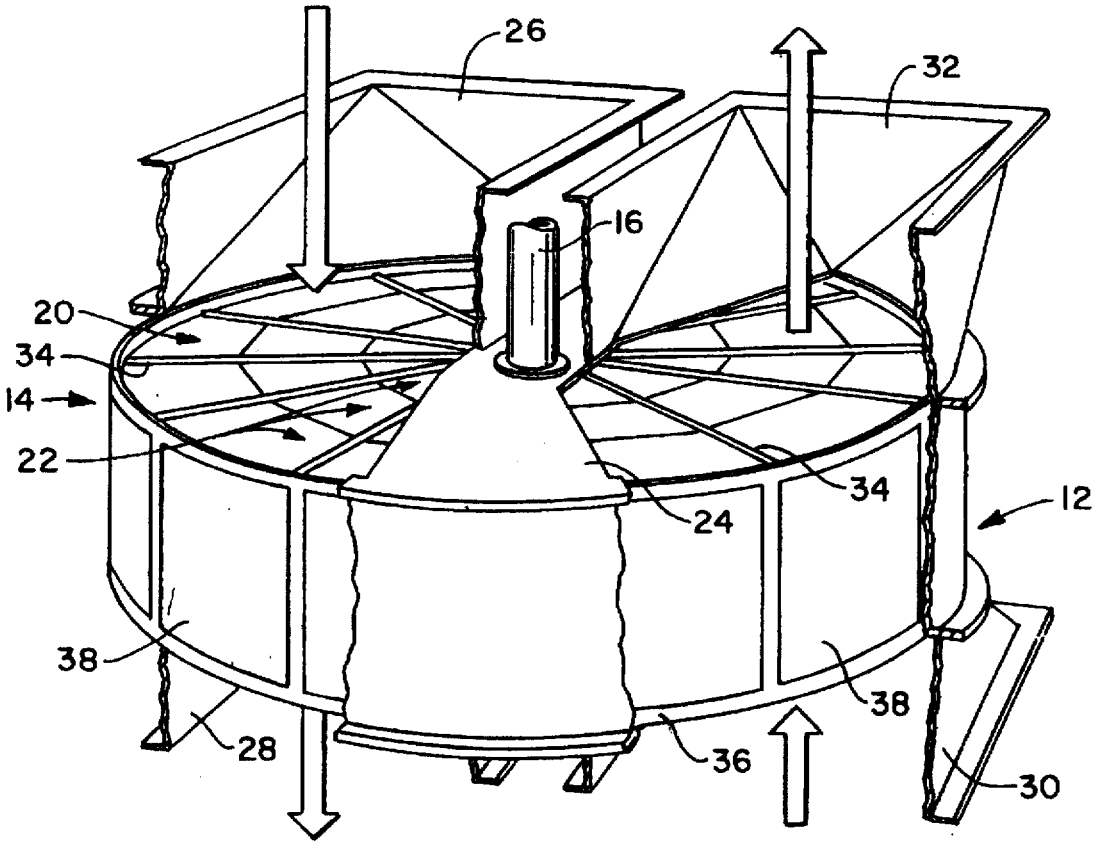
FIG. 1 is a general perspective view of a rotary regenerative heat exchanger.

FIG. 1 of the drawings is a partially cut-away perspective view of a typical air heater showing a housing 12 in which the rotor 14 is mounted on drive shaft or post 16 for rotation. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32. The basket modules 22 are loaded into the rotor 14 through the rotor shell 36 by removing the cover plates 38 and sliding the baskets radially into each sector 20.

Figure 2:
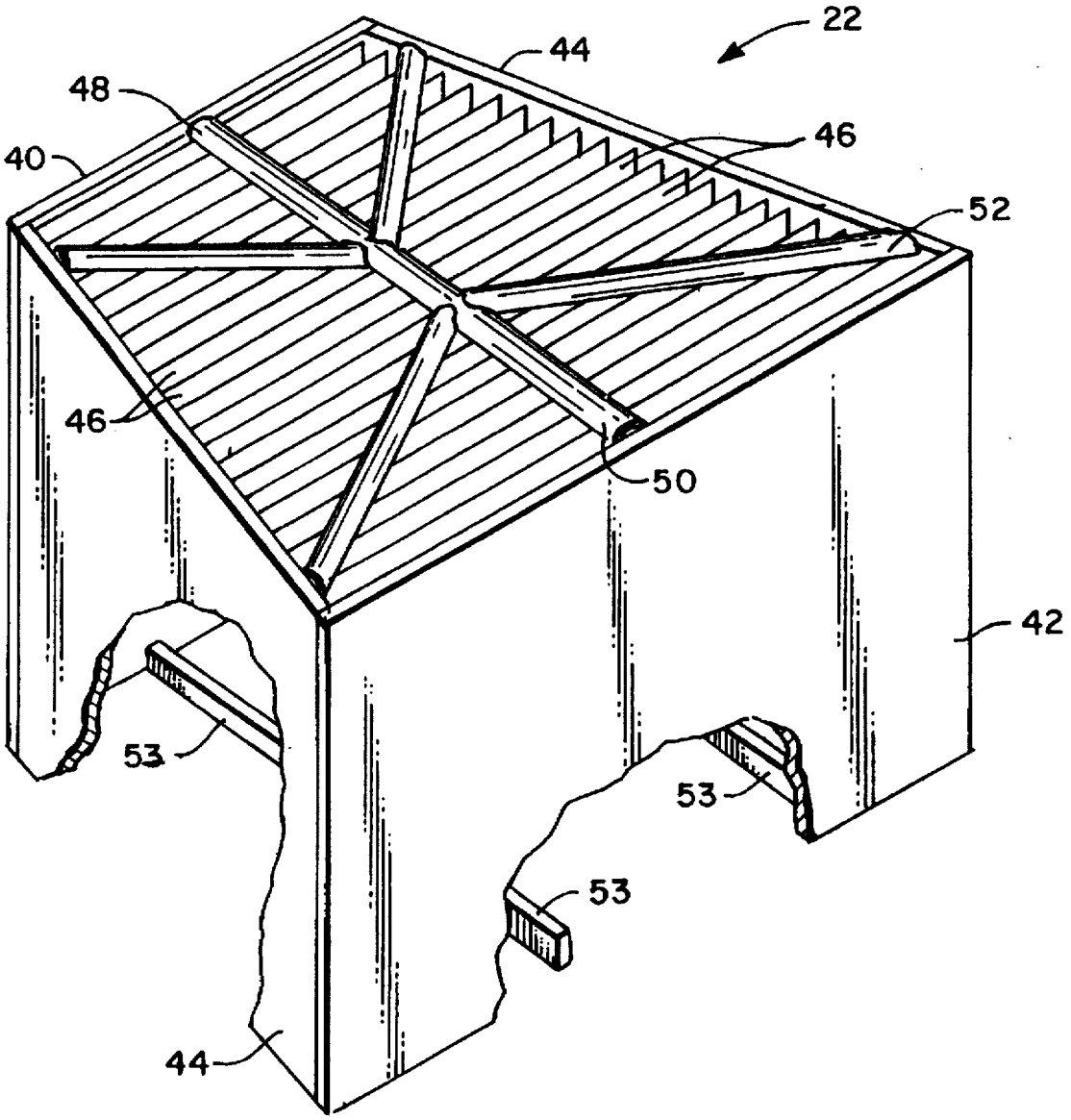
FIG. 2 is a perspective view of a basket module incorporating the present invention with portions broken away to show the structure.

FIG. 2 illustrates an individual basket module 22 of the present invention. The basket frame has an inboard end wall 40, an outboard end wall 42 and two side walls 44. The top and bottom of the basket are open for gas and air flow. Mounted within the basket frame are the spaced individual heat exchange plates 46 which may be of any desired type for purposes of the present invention.

Mounted on the top end of the basket module 22 is the integral grating 48. The particular grating 48 illustrated in FIG. 2 comprises a radially extending central member 50 and the several diagonal members 52. However, the particular configuration of the grating can vary and still be within the scope of the present invention. The grating 48 is attached to the walls of the basket module and extend slightly above the walls, perhaps about 0.6 cm (0.25 inches) above. Also, the upper edges of the grating members are rounded as illustrated in FIG. 2 to accommodate the sliding action between the grating and the adjacent basket above and help prevent interferences and hang-ups.

FIG. 2 also illustrates the arrangement of the bottom of the modules 22 as can be seen through the cut-outs in the one side wall 44 and the outboard end wall 42. For purposes of clarity, the individual heat exchange plates 46 are not shown through these cut-outs. Extending in a radial direction on the underside of the basket 22 are basket bars 53 which are fastened to the inboard and outboard ends such as by welding. These basket bars 53 are flush with the bottoms of the walls of the basket and act to support the upper baskets on the integral grating of the lower baskets.

Figure 3:
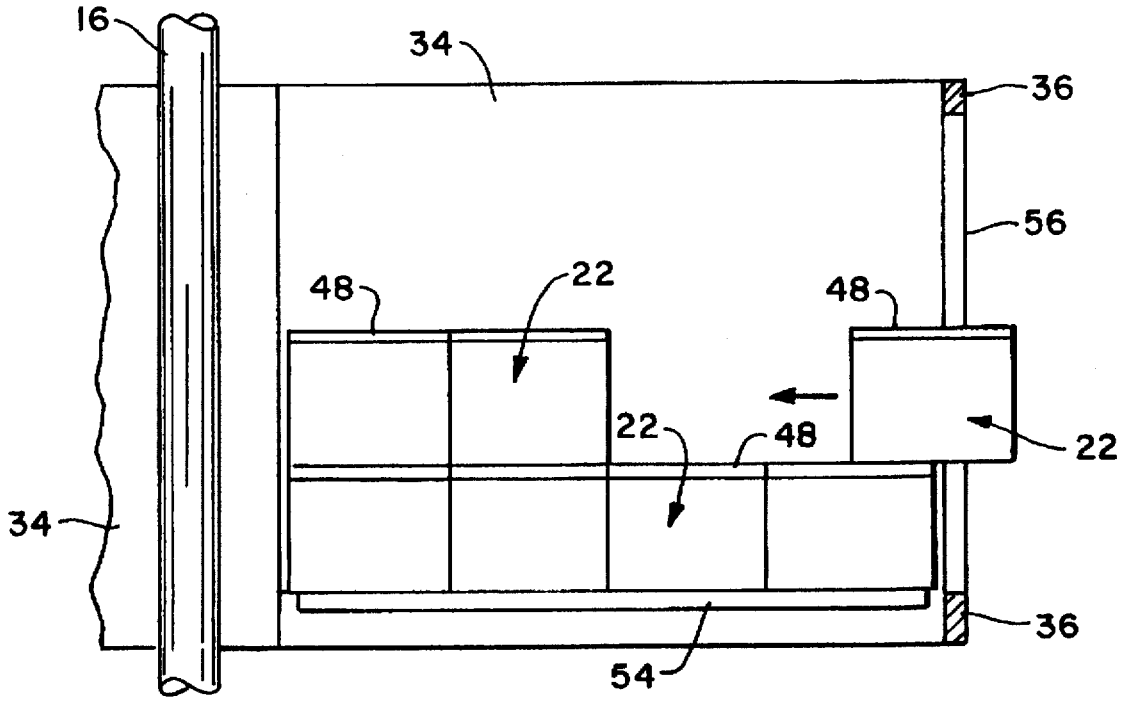
FIG. 3 is a cross-section view of a portion of an air preheater rotor illustrating the loading of the basket modules into the rotor.

FIG. 3 illustrates a cross-section through a portion of a rotor showing a sector of the rotor and the basket modules 22 located in and being loaded into the rotor. The rotor structure includes a lower grating 54 which is attached to and between the diaphragms 34. This grating 54 supports the lower layer of basket modules 22 which are normally the cold end baskets. These baskets in the lower layer have been loaded through the opening 56 in the rotor shell 36 after removal of the cover plates 38. After the lower layer is loaded by sliding the baskets in on the grating 54, the next higher layer is loaded by sliding the basket modules 22 in this layer across the integrated gratings 48 on the modules 22 in the first layer. This process is repeated until all of the baskets have been loaded with each of the upper layers being supported on the integrated grating 48 of the next lower layer.

The integral gratings of the present invention function as a sliding surface for installation and removal of the basket in the next higher adjacent layer just as the gratings which are a part of the normal rotor structure. They also function as support means for those adjacent layers. This arrangement eliminates the need for multiple layers of grating as a part of the rotor structure. This will also reduce the thickness or height of the basket arrangement thereby reducing the overall height of the rotor.

I claim:

1. In a rotor assembly for a vertical shaft rotary regenerative heat exchanger wherein said rotor assembly includes a rotor shell around the periphery thereof, a plurality of radially extending diaphragm plates forming a plurality of rotor sectors and a support grating in the bottom of each of said sectors, the improvement comprising a plurality of heat exchange basket modules located in each of said sectors and arranged therein in a plurality of axially spaced layers including a bottom layer and at least one layer resting on top of said bottom layer, each of said plurality of heat exchange basket modules including an uppermost top surface and wherein each of said plurality of heat exchange basket modules in a layer which has an adjacent layer resting on the top thereof including an integral grating structure attached thereto on the upper surface thereof and extending partially above said uppermost top surface of said module thereby forming a support and sliding surface for said heat exchange basket modules in said adjacent layer resting on the top thereof.

2. A rotor assembly as recited in claim 1 wherein said rotor shell includes openings therein for inserting said heat exchange basket modules radially into said rotor sectors through said openings.

3. A rotor assembly as recited in claim 1 wherein said grating structure comprises a plurality of grating members each having rounded upper edges.

4. A heat exchange basket module for a vertical shaft rotary regenerative heat exchanger comprising a plurality of frame members defining a periphery of said basket modules including top and bottom surfaces thereof, a plurality of spaced heat exchange plates mounted in said basket module within said frame members wherein the improvement comprises an integral grating structure attached across said surface thereof and extending partially above said top surface thereby forming a support and sliding surface.

5. A heat exchange basket module as recited in claim 4 wherein said integral grating structure comprises a plurality of grating members each having rounded upper edges.

* * * * *